US007178970B2

(12) United States Patent
Chiu

(10) Patent No.: US 7,178,970 B2
(45) Date of Patent: Feb. 20, 2007

(54) CHRISTMAS BULB HOLDER ASSEMBLY

(76) Inventor: Ho-Hsin Chiu, No. 18, Donghua Rd., Hsinchu City 300 (TW)

( * ) Notice: Subject to any disclaimer, the term of this patent is extended or adjusted under 35 U.S.C. 154(b) by 0 days.

(21) Appl. No.: 10/949,240

(22) Filed: Sep. 27, 2004

(65) Prior Publication Data

US 2006/0067081 A1 Mar. 30, 2006

(51) Int. Cl.
*H01R 24/00* (2006.01)
*H01R 33/00* (2006.01)

(52) U.S. Cl. ..... 362/654; 439/699.2

(58) Field of Classification Search ..... 362/654; 439/699.2

See application file for complete search history.

(56) References Cited

U.S. PATENT DOCUMENTS 6,053,620 A * 4/2000 Won ..... 362/653

6,361,368 B1 * 3/2002 Tseng ..... 362/654

* cited by examiner

*Primary Examiner*—Ali Alavi
*Assistant Examiner*—William J. Carter
(74) *Attorney, Agent, or Firm*—Rabin & Berdo, P.C.

(57) ABSTRACT

A Christmas bulb holder assembly includes a bulb including a rectangular base, a cylindrical vent tube centrally located on the base, and two filament wires; a bulb holder including a flared upper end and a lower connection member including a diametric slot extended downward from bottom of the upper end, and two opposite curved walls formed on central portions of the slot wherein the base is conformed to the slot and the vent tube is conformed to a space defined by the walls such that the bulb is adapted to secure to the bulb holder with the vent tube fastened by the walls; and a mounting including an upper sleeve conformed to the connection member. The assembled bulb and bulb holder are secured to the mounting with the connection member fastened in the sleeve and the filament wires connected to end contacts of electric wires after passing the bulb holder.

2 Claims, 6 Drawing Sheets

CHRISTMAS BULB HOLDER ASSEMBLY

BACKGROUND OF THE INVENTION

1. Field of Invention

The present invention relates to lamps and more particularly to an assembly for securely holding a snap-in Christmas bulb.

2. Related Art

Christmas lamps are well known. A conventional Christmas lamp is shown in FIG. 1 and comprises a bulbous bulb 10 having conductive external threads 20 on its cylindrical base, and a tubular socket 30 having conductive internal threads on its inner surface. In assembly, the external threads 20 and the internal threads of the socket 30 are threaded together.

However, the conventional Christmas lamp suffered from a couple of disadvantages. For example, the threaded engagement of the bulb 10 and the socket 30 is time consuming. Also, the engagement is not reliable. That is, it may become loose after a short time of use, resulting in a poor contact. Thus, the need for improvement still exists in order to contribute significantly to the advancement of the art.

SUMMARY OF THE INVENTION

It is therefore an object of the present invention to provide a Christmas bulb holder assembly having advantages of being ease of assembly, secure, and durable.

To achieve the above and other objects, the present invention provides a Christmas bulb holder assembly comprising a bulb including a rectangular base, a cylindrical vent tube centrally located on the base, and two filament wires extended downward from inside of the bulb through both sides of the vent tube to the external; a hollow bulb holder formed of a flexible plastic material, the bulb holder including a flared upper end and a lower connection member including a diametric slot extended downward from a bottom of the upper end, and two opposite curved clamping walls each formed on a central portion of either longitudinal surface of the slot wherein the base is conformed to the slot and the vent tube is conformed to a space defined by the clamping walls such that the bulb is adapted to secure to the bulb holder with the vent tube fastened by the clamping walls and the filament wires inserted through the connection member to extend therefrom by inserting the base into the slot; and a mounting formed of a flexible plastic material, the mounting including an upper sleeve conformed to the connection member, and a lower portion including two internal contacts formed at two ends of two electric wires extended to the external such that the assembled bulb and the bulb holder are adapted to secure to the mounting with the connection member fastened in the sleeve and the filament wires securely connected to the contacts by inserting the connection member into the sleeve.

In one aspect of the present invention the connection member comprises a rectangular lower portion.

The above and other objects, features and advantages of the present invention will become apparent from the following detailed description taken with the accompanying drawings.

| Code Number: | |
|---|---|
| (10) Lamp's shell | (20) Lamp cover |
| (30) Lamp holder | (40) Lamp's shell |
| (41) Lamp head | (42) Air hole part |
| (50) Lamp cover | (51) Clips |
| (52) Notch | (53) Space |
| (54) Jointing | (55) Jointing part |
| (60) Lamp holder | (61) Mouth of lamp holder |

DETAILED DESCRIPTION OF THE INVENTION

Figure 1:
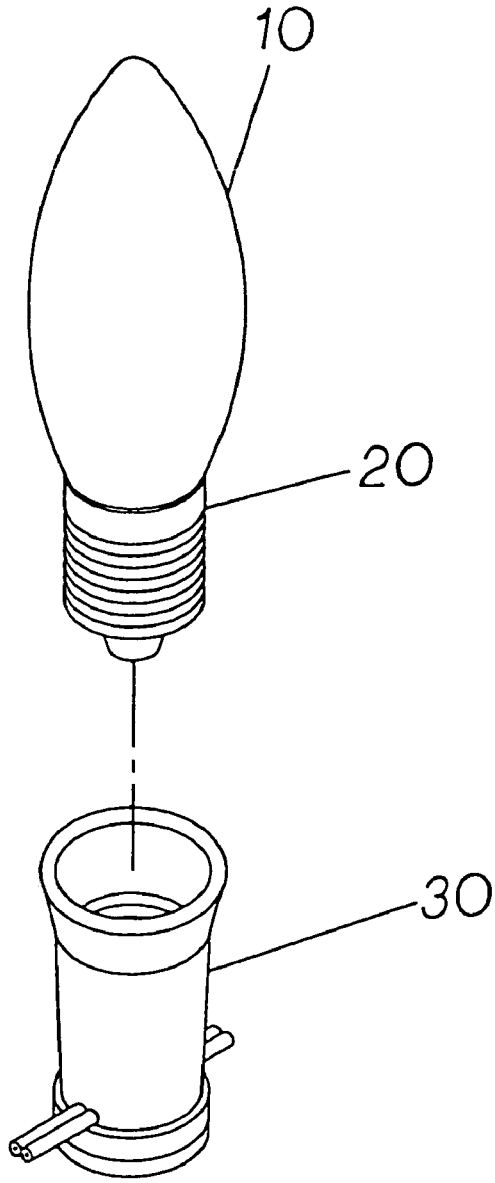
FIG. 1 PRIOR ART
FIG. 1 is an exploded view of a conventional Christmas lamp.
Figure 2:
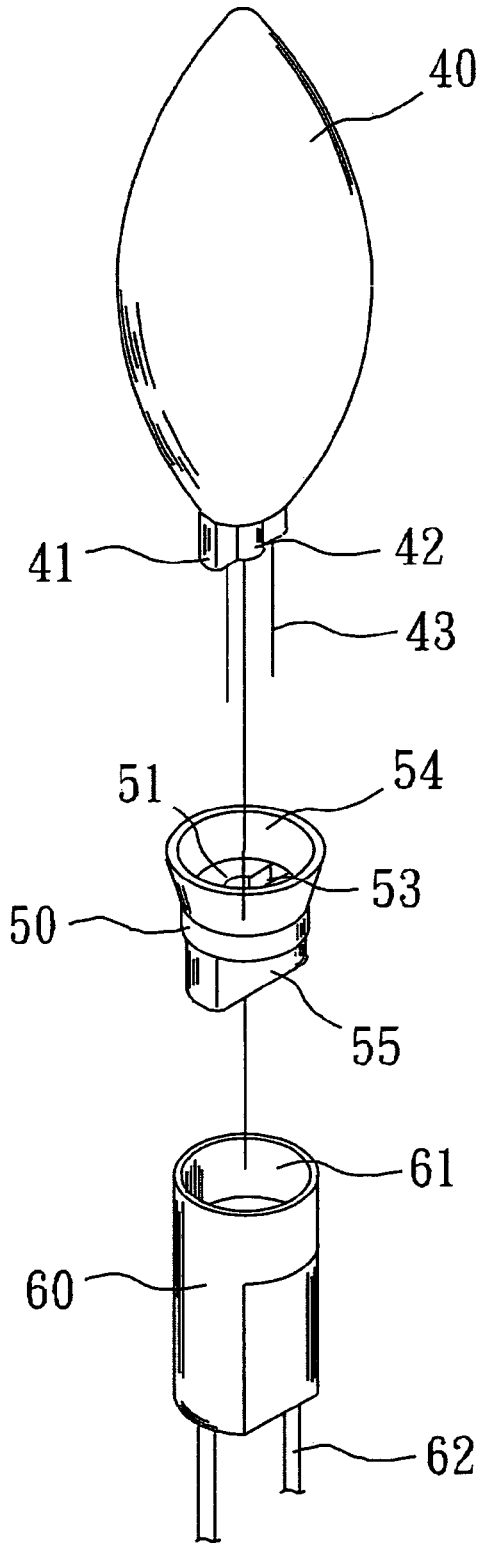
FIG. 2 is an exploded view of a preferred embodiment of Christmas bulb holder assembly according to the invention.
Figure 3:
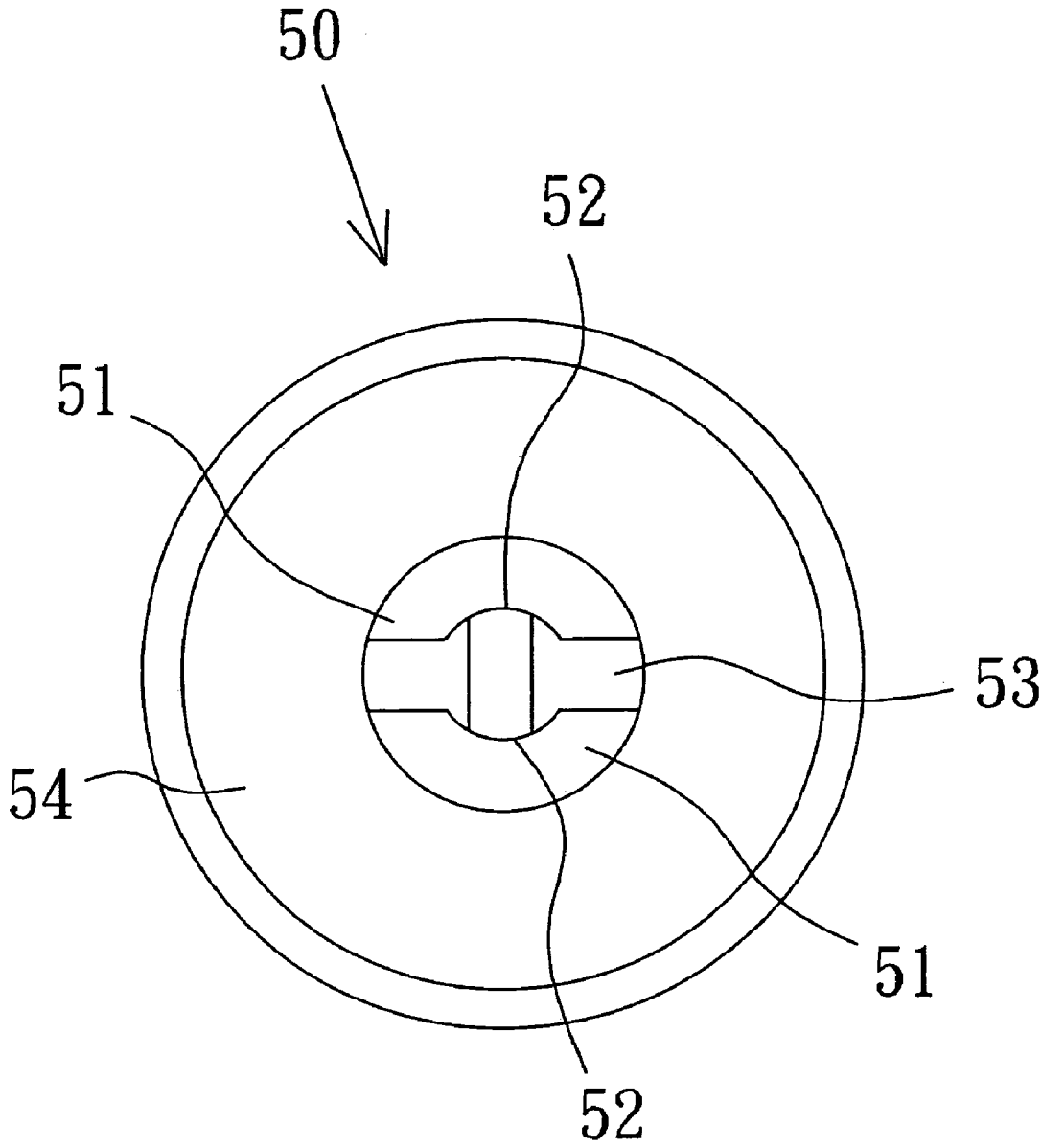
FIG. 3 is a top plan view of the bulb holder in FIG. 2.
Figure 4:
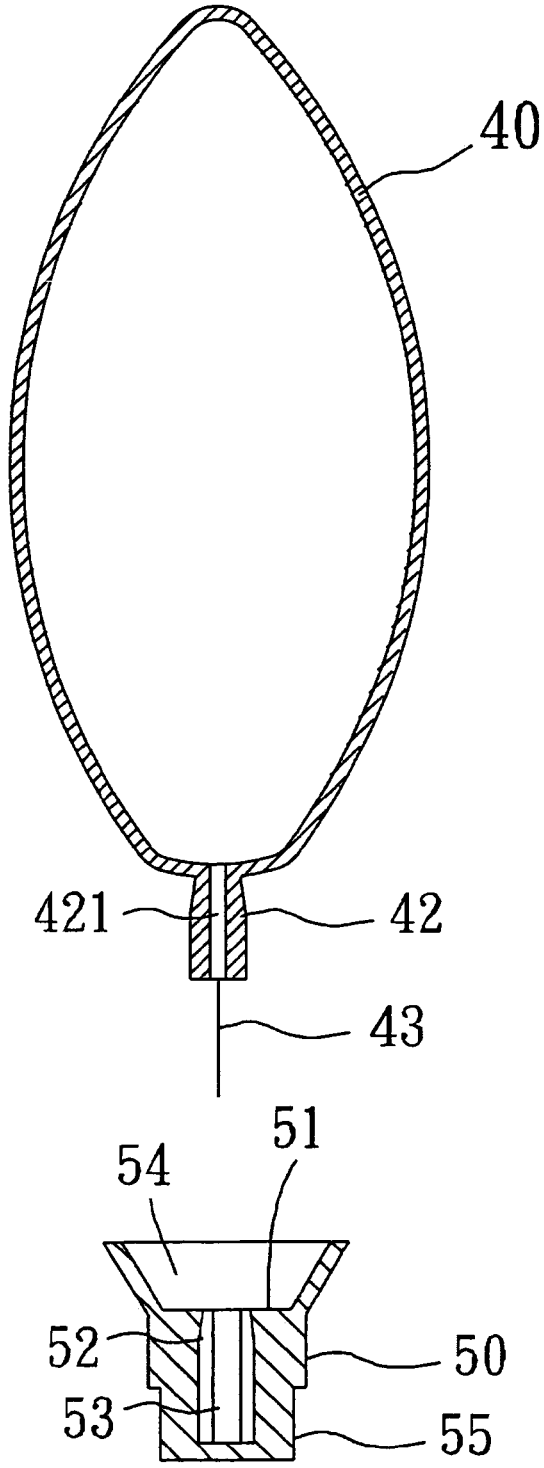
FIG. 4 is a longitudinal sectional view of the bulb and the bulb holder in FIG. 2 to be assembled.
Figure 5:
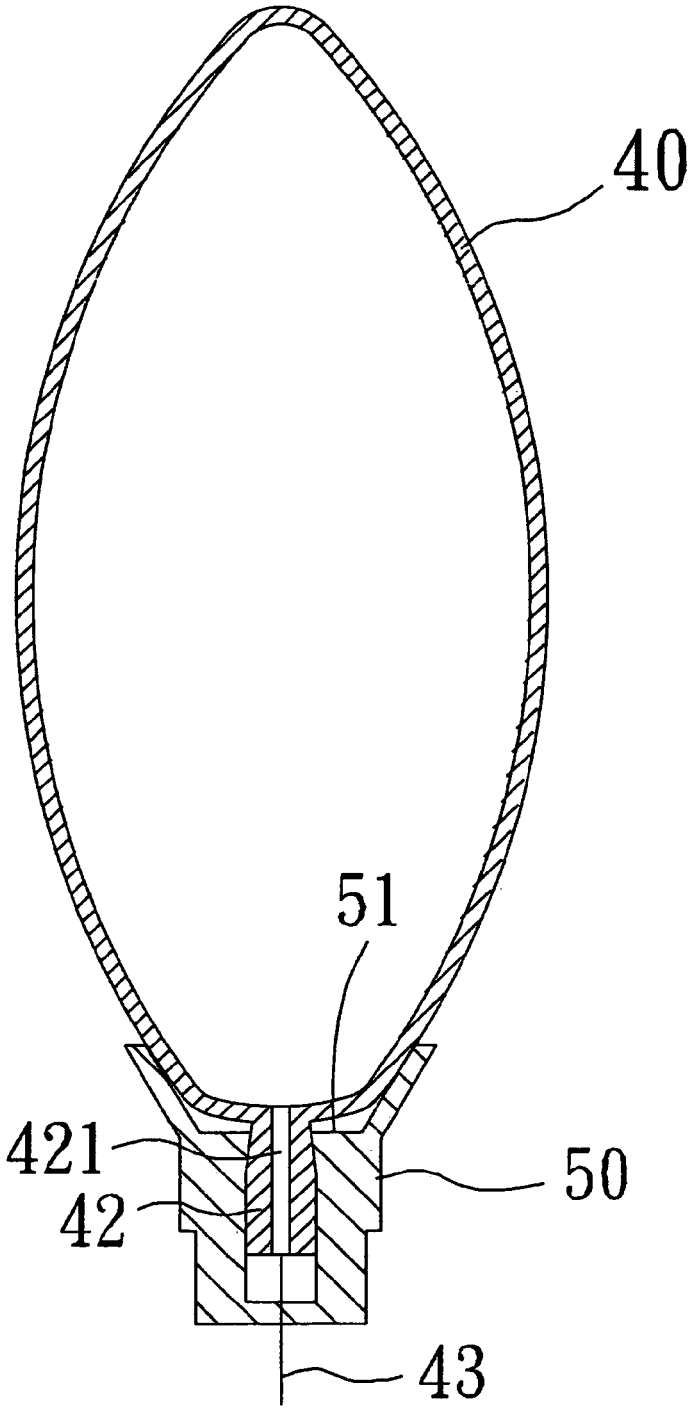
FIG. 5 is a view similar to FIG. 4 where the bulb and the bulb holder are assembled.
Figure 6:
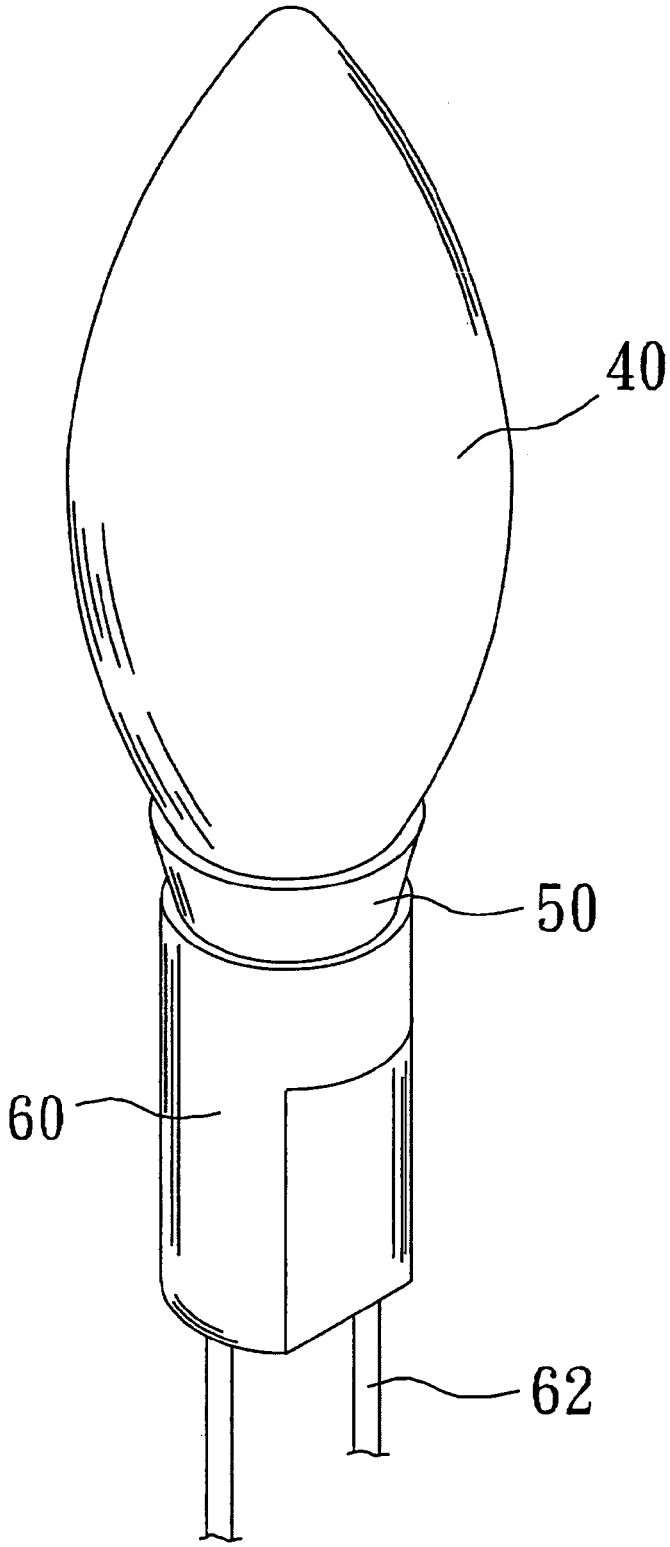
FIG. 6 is a perspective view of the assembled Christmas bulb holder assembly.

Referring to FIGS. 2 to 6, a Christmas bulb holder assembly in accordance with a preferred embodiment of the invention comprises a bulb 40, a bulb holder 50, and a mounting 60. Each component is discussed in detailed below.

The bulb 40 is substantially oval and comprises a substantially rectangular base 41, a cylindrical vent tube 42 having a longitudinal channel 421 in communication with the external and an evacuated chamber of the bulb 40, the vent tube 42 being centrally located on the base 41 for separating the base 41 into two side wings and projecting from both surfaces of the base 41, and two filament wires 43 each extended downward from the evacuated chamber of the bulb 40 through the side wing of the base 41 to the external.

The bulb holder 50 is hollow and is formed of a flexible plastic material. The bulb holder 50 comprises a flared upper end 54 for defining an outwardly diverging cavity, a cylindrical intermediate portion, and a lower connection member 55 of substantially rectangular. Within the intermediate portion and the connection member 55 there are provided a diametric slot 53 extended downward from a bottom of the upper end 54 for separating the bottom of the upper end 54 into two equal clamping halves 51, and two opposite curved clamping walls 52 each formed on a central portion of either longitudinal surface of the slot 53. The slot 53 has a depth longer than a height of the base 41. Also, the height of the base 41 is substantially equal to a depth of either clamping wall 52. Further, shapes of the base 42 and the vent tube 42 are conformed to that of the slot 53 and the clamping walls 52 respectively.

The substantially cylindrical mounting 60 is formed of a flexible plastic material and comprises an upper sleeve 61 having a recess conformed to shape of the intermediate portion and the connection member 55 of the bulb holder 50.

An assembly of the invention will be described in detailed below. First, snappingly insert the bulb 40 into the bulb holder 50 by aligning the base 41 with the slot 53 until being stopped. As a result, the base 41 is positioned in the slot 53 with the vent tube 42 fastened by the clamping walls 52 (see FIG. 5). Also, the filament wires 43 insert through the connection member 55 to extend therefrom. Next, snappingly insert the assembled bulb 40 and the bulb holder 50 into the sleeve 61 by aligning the intermediate portion and the connection member 55 of the bulb holder 50 with the recess of the sleeve 61 until being stopped. At this position, both the bulb 40 and the bulb holder 50 are fastened in the mounting 60. Also, the filament wires 43 are securely connected to two contacts (not shown) within a lower portion of the mounting 60. The contacts are formed at two ends of two electric wires 62 as well known in the art. As an end, a complete Christmas lamp is formed (see FIG. 6).

While the invention herein disclosed has been described by means of specific embodiments, numerous modifications and variations could be made thereto by those skilled in the art without departing from the scope and spirit of the invention set forth in the claims.

What is claimed is:

1. A Christmas bulb holder assembly, comprising:

a bulb having a rectangular base, a cylindrical vent tube centrally located on the base, and two filament wires extended downward from inside of the bulb through the base and at both sides of the vent tube to the external;

a hollow bulb holder formed of a flexible plastic material and having a flared upper end and a lower connection member, a diametric slot being formed in said lower connection member and extending downward from a bottom of the upper end, the slot defining two opposite curved clamping walls each formed on a central portion of either longitudinal surface of the slot, wherein the base of the bulb conforms to the slot and the vent tube conforms to a space defined by the clamping walls such that the bulb is adapted to be secured to the bulb holder with the vent tube being fastened by the clamping walls and the filament wires being inserted through the connection member to extend therefrom by inserting the base into the slot; and a mounting formed of a flexible plastic material and including an upper sleeve conforming to the connection member, and a lower portion including two internal contacts formed at two ends of two electric wires that extend to the external such that the assembled bulb and bulb holder are adapted to be secured to the mounting with the connection member being fastened in the sleeve and the filament wires being securely connected to the contacts by inserting the connection member into the sleeve.

2. The Christmas bulb holder assembly of claim 1, wherein the connection member has a rectangular lower portion.

* * * * *